US009034109B2

(12) United States Patent
Tuller

(10) Patent No.: US 9,034,109 B2
(45) **Date of Patent: *May 19, 2015**

(54) DISHWASHER WITH WASH LOAD DETECTION

(71) Applicant: Whirlpool Corporation, Benton Harbor, MI (US)

(72) Inventor: Barry E. Tuller, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/288,681

(22) Filed: May 28, 2014

(65) Prior Publication Data

US 2014/0261553 A1 Sep. 18, 2014

Related U.S. Application Data

(63) Continuation of application No. 12/908,027, filed on Oct. 20, 2010.

(51) Int. Cl.

| | |
|---|---|
| ***A47L 15/18*** | (2006.01) |
| ***A47L 15/22*** | (2006.01) |
| ***A47L 15/42*** | (2006.01) |
| ***A47L 15/00*** | (2006.01) |

(52) U.S. Cl.

CPC ..... *A47L 15/4295* (2013.01); *A47L 15/0049* (2013.01); *A47L 15/22* (2013.01); *A47L 15/4221* (2013.01); *A47L 2401/04* (2013.01); *A47L 2401/10* (2013.01); *A47L 2401/32* (2013.01); *A47L 2501/03* (2013.01); *A47L 2501/07* (2013.01); *A47L 2501/20* (2013.01); *A47L 2501/30* (2013.01); *A47L 2401/24* (2013.01)

(58) Field of Classification Search

CPC . A47L 2501/20; A47L 2501/30; A47L 15/22; A47L 15/4221; A47L 15/4282; A47L 2401/04

USPC ..... 134/57 D, 58 D, 18, 25.1, 25.2

See application file for complete search history.

(56) References Cited

U.S. PATENT DOCUMENTS

| | | | | |
|---|---|---|---|---|
| 5,131,419 | A * | 7/1992 | Roberts | 134/50 |
| 6,325,083 | B1 * | 12/2001 | Worter | 134/180 |
| 2006/0278258 | A1 * | 12/2006 | Kara et al. | 134/56 D |
| 2007/0272272 | A1 * | 11/2007 | Choi et al. | 134/18 |
| 2009/0056754 | A1 * | 3/2009 | Rolek | 134/18 |
| 2010/0101611 | A1 * | 4/2010 | Chen et al. | 134/25.2 |
| 2011/0120500 | A1 * | 5/2011 | Heisele et al. | 134/25.2 |

FOREIGN PATENT DOCUMENTS

JP 2009273490 A * 11/2009

* cited by examiner

*Primary Examiner* — Michael Kornakov
*Assistant Examiner* — Katelyn Whatley

(57) ABSTRACT

A method of operating a dishwasher having a tub at least partially defining a treating chamber for receiving utensils and a spraying system spraying liquid in the treating chamber, to determine at least one parameter of the cycle of operation based on the set of load condition by selectively spraying liquid in multiple portions of the treating chamber.

15 Claims, 4 Drawing Sheets

DISHWASHER WITH WASH LOAD DETECTION

CROSS-REFERENCE TO RELATED APPLICATIONS

This application is a continuation of U.S. application Ser. No. 12/908,027, filed Oct. 20, 2010, and entitled Dishwasher with Wash Load Detection, which is incorporated by reference herein in its entirety.

BACKGROUND OF THE INVENTION

Contemporary dishwashers for use in a typical household include a tub at least partially defining a treating chamber for storing utensils during the implementation of a wash cycle. One or more spray arms may rotate about an axis of rotation to provide a spray of liquid to treat utensils that may be stored in the treating chamber. When users load the utensils within the treating chamber, they are often loaded for convenience, without consideration for loading factors, resulting in soil load, soil type, utensil type, and utensil arrangement not being uniform across the treating chamber in the dishwasher.

BRIEF DESCRIPTION OF THE INVENTION

In one aspect, an embodiment of the invention relates to a method of operating a dishwasher having a tub at least partially defining a treating chamber for receiving utensils to form a wash load, a spraying system having at least one rotatable spray arm, a liquid supply system supplying liquid to the spraying system, and a drive mechanism for rotating at least one rotatable spray arm controlled according to a cycle of operation, the method includes operating the drive mechanism to incrementally rotate the rotatable spray arm through multiple portions of the treating chamber about an axis of rotation, which is fixed relative to the treating chamber, and independently of the supply of liquid to the at least one rotatable spray arm, selectively spraying liquid in the multiple portions of the treating chamber during the incremental rotation, receiving a load input for at least some of the multiple portions from at least one sensor in response to the selectively spraying, determining a load condition for at least those multiple portions having a load input to define a set of load conditions for the wash load, and setting at least one parameter of the cycle of operation based on the set of load conditions.

DESCRIPTION OF EMBODIMENTS OF THE INVENTION

The invention is generally directed toward determining a load condition in one or more portions of a treating chamber of a dishwasher. Each portion of the treating chamber is sprayed and a corresponding load condition for each portion may be determined by one or more sensors. At least one parameter of a cycle of operation for the dishwasher may be set based on the load condition. The invention addresses problems associated with a non-uniformly distributed load in the treating chamber to improve the quality of treatment using tailored cycle of operation for each portion of the treating chamber.

Figure 1:
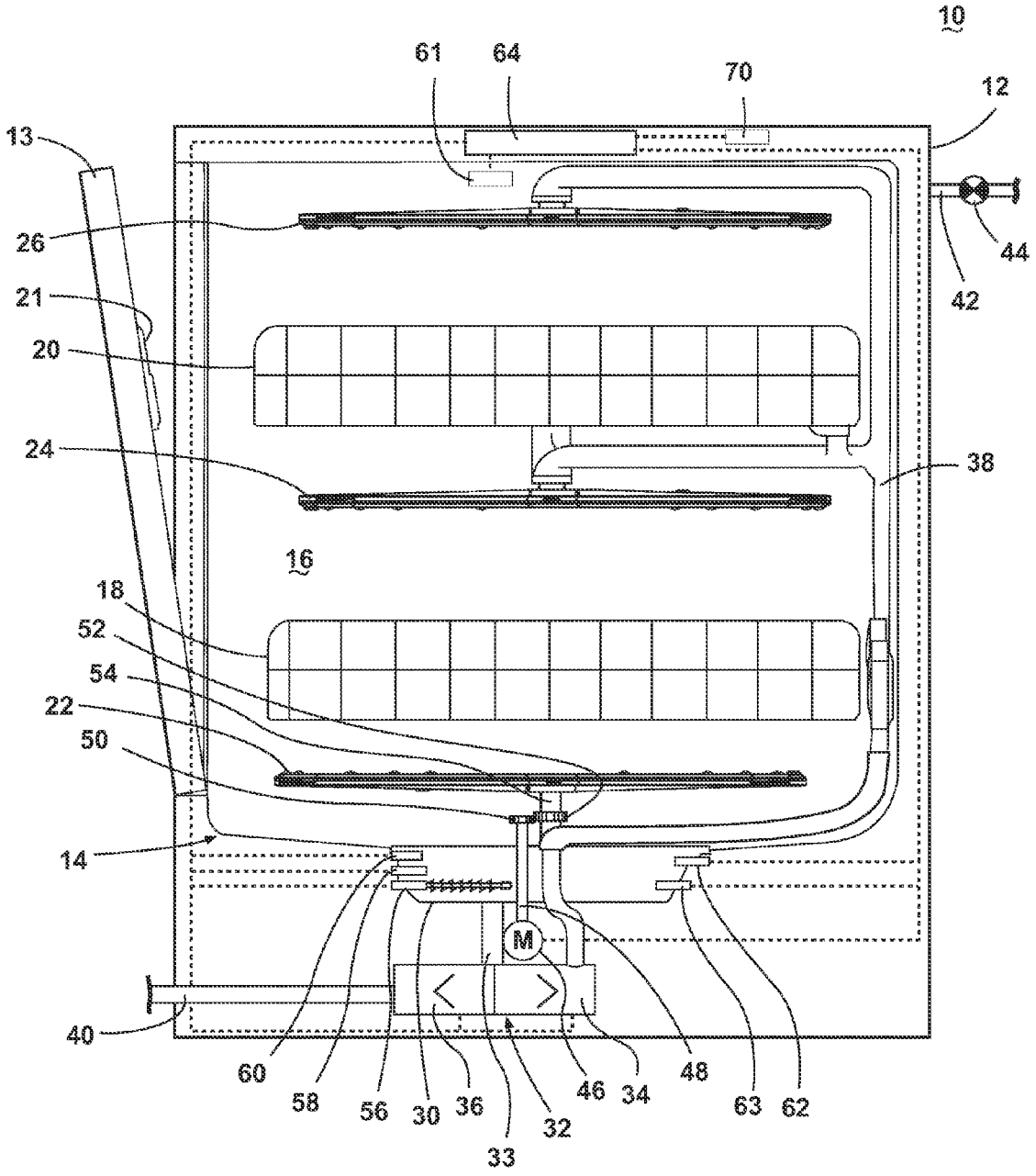
FIG. 1 is a perspective side view of a dishwasher having rotatable spray arms and a drive mechanism coupling the rotation of the spray arms according to a first embodiment of the invention.

FIG. 1 is a perspective side view of a treating appliance according to a first embodiment of the invention, which is illustrated in the context of a dishwasher 10. While the illustrated treating appliance is a dishwasher 10, other treating appliances are possible, non-limiting examples of which include other types of dishwashing units, such as in-sink dishwashers, multi-tub dishwashers, or drawer-type dishwashers. The dishwasher 10, which shares many features of a conventional automated dishwasher, will not be described in detail herein except as necessary for a complete understanding of the invention.

The dishwasher 10 may have a cabinet 12 defining an interior, which is accessible through a door 13. The cabinet 12 may comprise a chassis or frame to which panels may be mounted. For built-in dishwashers, the outer panels are typically not needed. At least one tub 14 is provided within the interior of the cabinet 12 and at least partially defines a treating chamber 16 to receive and treat utensils according to a cycle of operation, which may a wash cycle. The tub 14 may have an open face that is closed by the door 13.

For purposes of this description, the term "utensil(s)" is intended to be generic to any item, single or plural, that may be treated in the dishwasher 10, including, without limitation; dishes, plates, pots, bowls, pans, glassware, and silverware.

One or more utensil racks, such as a lower utensil rack 18 and an upper utensil rack 20 may be provided in the treating chamber 16. The racks 18, 20 hold utensils (not shown) that may be treated in the treating chamber 16. The racks 18, 20 may be slid in and out of the treating chamber 16 through the opening closed by the door 13.

A detergent dispenser 21 may be located in the door 13. It will be understood that depending on the type of dishwasher and the type of detergent used, the detergent dispenser 21 may be incorporated into one dispensing mechanism. The detergent dispenser 21 may be of a single use dispenser type or a bulk dispenser type. In the case of bulk dispensing, the bulk dispenser may have multiple containers for multiple doses of detergent or treating aid such that the detergent or rinse aid can be selectively dispensed into the treating chamber 16 in a regulated quantity and at a predetermined time or multiple times during a cycle of operation.

A liquid supply system is provided for supplying liquid to the treating chamber 16 as part of a wash cycle for washing any utensils within the racks 18, 20. The liquid supply system includes one or more liquid sprayers, which are illustrated in the form of lower, mid, and upper level spray arms 22, 24, 26 that are provided within the treating chamber 16 and are oriented relative to the racks 18, 20 such that liquid sprayed from the spray arms 22, 24, 26 may be directed into one or more of the racks 18, 20.

It should be noted that the stacked arrangement of the utensil racks and the spray arm assemblies are not limiting to the invention, and merely serve to illustrate the invention. For example, the invention may be implemented in a stacked arrangement having a silverware basket, the lower and upper utensil rack, and with upper, middle, and lower level spray arm assemblies having spray heads for the silverware basket alternatively arranged in between the lower and upper utensil rack.

The liquid supply system further comprises a sump 30 to collect by gravity, liquid sprayed within the treating chamber 16. The sump 30 is illustrated as being formed with or affixed to a lower portion of the tub 14 to collect liquid that may be supplied into or circulated in the tub 14 during, before or after a cycle of operation. However, the sump 30 may be remote from the tub 14 and fluidly coupled by suitable fluid conduits. A heater 56 may be located within the sump 30 to selectively heat liquid collected in the sump 30.

The liquid supply system further comprises a pump assembly 32 fluidly coupled to the sump 30 by sump conduit 33, and as illustrated, may include a wash pump 34 and a drain pump 36. The wash pump 34 fluidly couples the sump 30 to the spray arm assemblies 22, 24, 26 through a spray arm supply conduit 38 to recirculate liquid that collects in the sump to the spray arm assemblies 22, 24, 26 for spraying on the racks 18, 20. The drain pump 36 fluidly couples the sump 30 to a drain conduit 40 for draining liquid collected in the sump 30 to a household drain, such as a sewer line, or the like. The spray arm assemblies may have at least one or more outlets (not shown) fluidly coupled to the spray arm supply conduit to be provided with a liquid of spray from the sump 30.

While the pump assembly 32 may include the wash pump 34 and the drain pump 36 in an alternative embodiment, the pump assembly 32 may include a single pump, which may be operated to supply liquid to either the drain conduit 40 or the spray arm support conduit 38, such as by rotating in opposite directions or by valves.

The liquid supply system further comprises a water supply conduit 42 fluidly coupling a household water supply to the sump 30. A control valve 44 controls the flow of water from the household water supply to the sump 30.

A drive mechanism may be provided for selective and discrete rotation of at least one of the spray arms in the treating chamber 16. The drive mechanism may include a motor 46 that is operably coupled to a drive shaft 48 extending through the tub 14. The drive mechanism may further include a drive gear 50 on the end of the drive shaft 48. The drive gear 50 may have any suitable configuration and size, and may be directly or indirectly coupled with one or more optional sprayers in the tub 14. For example, the drive gear 50 may be operably coupled to the idle gear 52 that is coupled to the rotational shaft 54 extending from the lower level spray arm assembly 22. In another embodiment, the drive gear 50 may be rotationally coupled to the rotational shaft 54 such that the drive gear 50 may be enmeshed to the teeth formed on the rotational shaft 54. It is noted that the drive mechanism be of any suitable type, such as for example, a crank, a gear, a gear train, a gear belt or a combination thereof. In yet another embodiment, an optional third idler gear operably may couple the drive gear 50 and the idle gear 52.

When the motor 46 rotates the drive shaft 48, one or more of the rotatable spray arms 22, 24, 26, which may be coupled to the drive shaft 48 through the drive gear 50 and optional idle gear 52, or any belt may rotate accordingly. The incremental rotational speed and direction of the spray arm may be controlled by the motor 46 and gears coupled to the motor 46. The rotatable spray arm may have one or more outlets to selectively spray liquid toward the utensils in the racks.

Such a drive mechanism is fully set forth in detail in U.S. patent application Ser. No. 12/433,016, filed Apr. 30, 2009, now U.S. Pat. No. 8,347,898, issued Jan. 8, 2013, and titled "Dishwasher with Rotating Zone Wash Sprayers," U.S. patent application Ser. No. 12/398,206, filed Mar. 5, 2009, now abandoned and titled "Dishwasher with a Drive Motor for Filter or Spray Arm", U.S. patent application Ser. No. 12/336,033, filed Dec. 16, 2008, now U.S. Pat. No. 8,113,222, issued Feb. 14, 2012, and titled "Dishwasher with Driven Spray Arm for Upper Rack", and U.S. patent application Ser. No. 12/761,438, filed Apr. 16, 2010, now U.S. Pat. No. 7,980,260, issued Jul. 19, 2011, and titled "Dishwasher with Driven Rotatable Spray Arm", which are incorporated herein by reference in its entirety.

The dishwasher 10 further comprises a control system having various components and sensors for controlling the flow and condition of the liquid to implement a wash cycle. The heater 56 may be an immersion heater in direct contact with liquid in the sump 30 to provide the liquid with predetermined heat energy. A temperature sensor such as a thermistor 58 may be provided in the sump 30 to provide an output that is indicative of the temperature of any fluid, liquid or air, in the sump 30. A pH sensor 60 may be also located near the bottom of the wall or in the sump 30 and provide an output indicative of the pH of the liquid in the sump 30. One or more sound sensors 61 may be also located near the spray arm assembly while it may be positioned anywhere in the tub 14 to provide an output signal such as an acoustic signature indicative of the arrangement and location of utensils in the racks 18, 20. A turbidity sensor 62 may be also located in the sump 30 or near the bottom of the wall and provide an output that is indicative of the turbidity of the liquid in the sump 30. A chemical sensor 63 may be further located in the sump 30 or near the bottom of the wall and provide any chemical characteristic of soil in the liquid.

Figure 2:
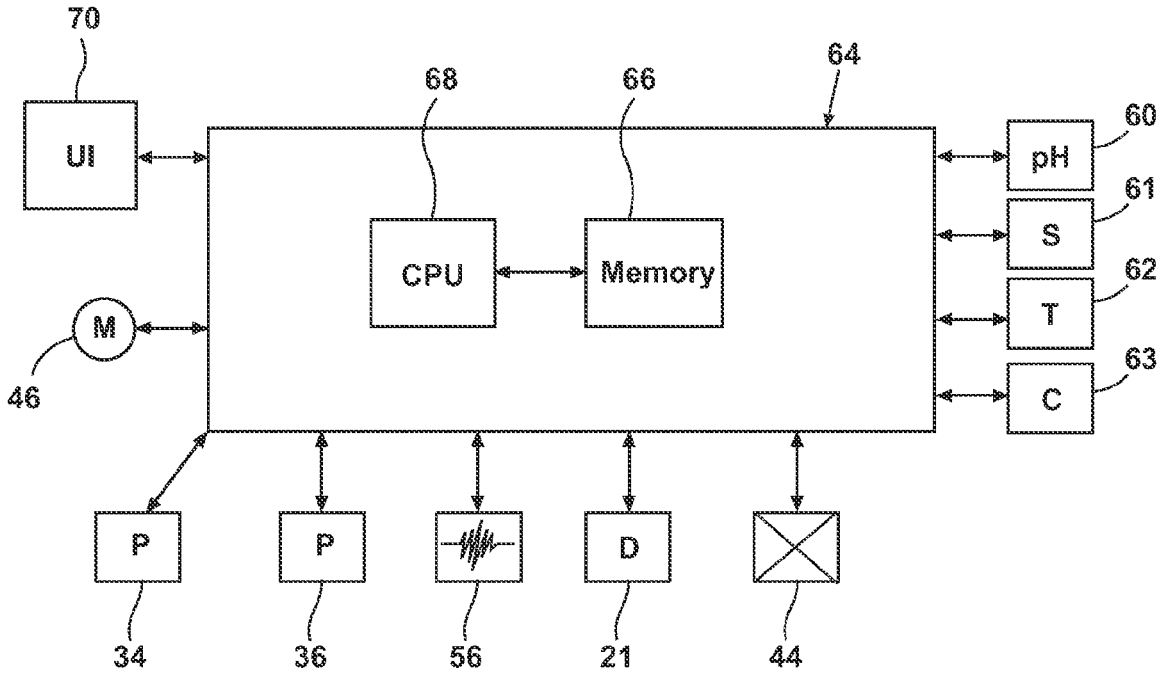
FIG. 2 is a schematic view of a controller of the dishwasher in FIG. 1.

Referring to FIG. 2, the control system may also include a controller 64 communicably and/or operationally coupled one or more components to receive an output signal from the components and control the operation of the dishwasher 10 to implement one or more cycles of operation. A user interface 70 may be provided to enable the user to input commands to the controller 64 and receive information about a specific treatment cycle from sensors in the dishwasher 10 or via input by the user through the user interface 70.

The controller 64 may be provided with a memory 66 and a central processing unit (CPU) 68. The memory 66 may be used for storing control software that may be executed by the CPU 68 in completing a cycle of operation using the dishwasher 10 and any additional software. For example, the memory 66 may store one or more pre-programmed cycles of operation that may be selected by a user and completed by the dishwasher 10. Non-limiting examples of cycles include normal, light/china, heavy/pots and pans, and rinse only. The memory 66 may also be used to store information, such as a database or table, and to store data received from one or more components of the dishwasher 10 that may be communicably coupled with the controller 64.

The controller 64 may be operably coupled with one or more components of the dishwasher 10 for communicating with and controlling the operation of the components to complete a cycle of operation. For example, the controller 64 may be coupled with the motor 46 to selectively rotate at least one spray arm assemblies, the heater 56 for heating the wash liquid during a cycle of operation, components of the liquid spraying system including the pump assembly 32 such as the wash pump 34 and drain pump 36, dispenser 21 for detergent or rinse aid, and valve 42 for dispensing treating chemistry and water to the treating chamber 16 during a cycle of operation.

The controller 64 may also receive input from one or more sensors for use in controlling the components. Non-limiting examples of sensors that may be communicably coupled with the controller 64 include the pH sensor 60, the sound sensor 61, the turbidity sensor 62, and the chemical sensor 63. The controller 64 may also receive inputs from one or more other sensors, which are known in the art and not shown for simplicity. Non-limiting examples of other sensors that may be communicably coupled with the controller 64 include a temperature sensor, a moisture sensor, a door sensor, a detergent and rinse aid presence/type sensor(s).

In some cases, the component may be its own sensor. For example, the motor 46 may be a step motor that provides very precise control over the rotation of the motor. Such motors provide feedback to the controller 64 regarding the rotational position of the motor.

The controller 64 may also be coupled with the user interface 70 for receiving user-selected inputs and communicating information to the user. The user interface 70 may be provided on the dishwasher 10 and operably coupled with the controller 64. The user interface 70 may be provided on the front of the housing 12, or on the outer panel of the door 22, and may include operational controls such as dials, lights, switches, and displays enabling a user to input commands to the controller 64 and receive information about the selected cleaning cycle and operating parameters.

The controller 64 may control the components of the dishwasher 10 to complete a cycle of operation stored in the memory 66 based on a setting of one or more operating parameters. The operating parameters may correspond, for example, to a type of utensil, a soil level, or an amount of utensils in the racks. The operating parameters may be set to control the components of the dishwasher 10 to provide the recommended utensil care for the selected cycle of operation. The operating parameters may be set automatically by the controller 64 when the user selects one of the pre-programmed cycles of operation stored in the memory 66. Alternatively, one or more of the operating parameters may be set by the user via the user interface 70 to modify one of the pre-programmed cycles of operation according to the user's preferences. For example, the user may select a zone within the treating chamber and then manually set a cleaning cycle for that zone, which may be different than the default wash cycle for the rest of the dishwasher 10.

Figure 3:
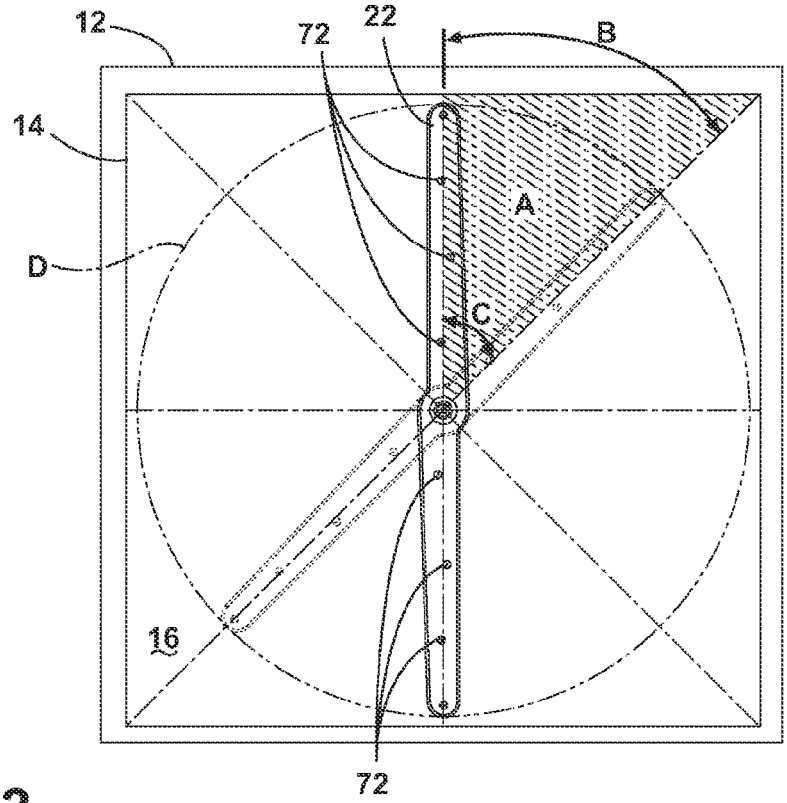
FIG. 3 is a schematic top view of the rotatable spray arm assembly of the dishwasher in FIG. 1, with the spray arm assembly incrementally rotating through an arc segment by 45 degrees about the axis of rotation in the tub according to a second embodiment of the invention.
Figure 4:
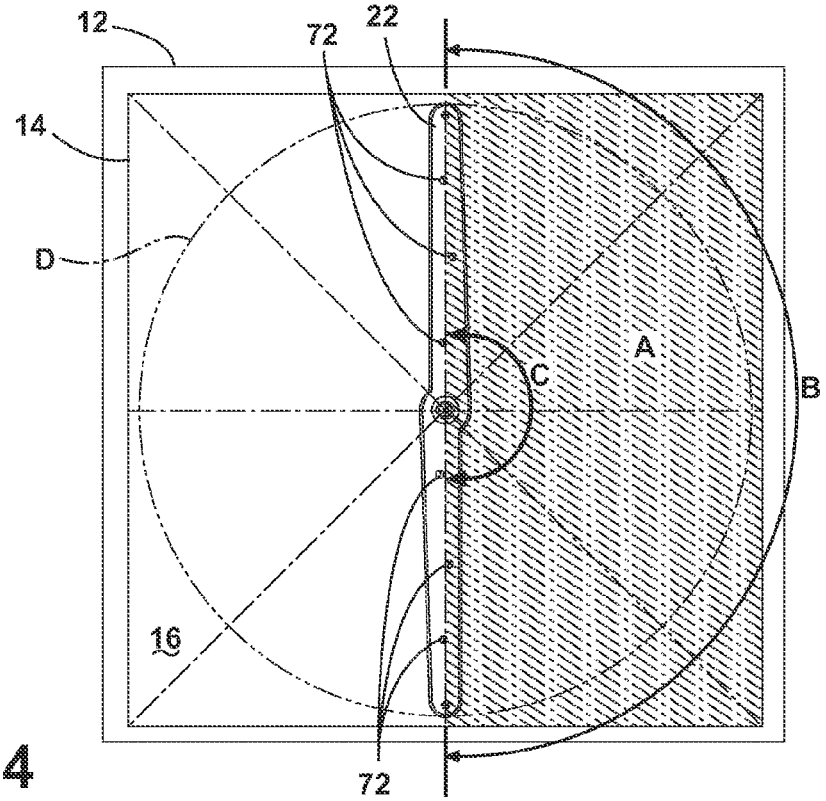
FIG. 4 is a schematic top view of the rotatable spray arm assembly of the dishwasher in FIG. 1, with the spray arm assembly incrementally rotating through an arc segment by 180 degrees about the axis of rotation in the tub according to a third embodiment of the invention.

FIGS. 3 and 4 are schematic top views of the rotatable spray arm assembly 22 of the dishwasher 10 in FIG. 1 according to embodiments of the invention, with the spray arm assembly incrementally rotating through an arc segments A by 45 and 180 degrees, respectively, about an axis of rotation, coming out of the page, which defines a plane of rotation, which is bounded by an outer periphery shown by line D. The arc segments 45 and 180 degrees are provided for illustration purposes only and are not limiting on the invention. Any desired arc segment may be used, such as 30, 60, or 90 degrees, or combination thereof, about the axis of rotation in other embodiments. For example, if the overall utensil load is not heavy, the spray arm may incrementally rotate through 180 degrees rather than rotating through 30 or 45 degrees. Multiple arc segments may be stepped through. However, multiple arc segments need not be of the same length, nor is it necessary to sequentially step through the multiple arc segments.

Although much of the remainder of this application is directed to the embodiment focused upon rotating lower spray arm assembly 22, the invention may be used in connection with one or more of other spray arm assemblies such as mid-level spray arm assembly 24, the upper spray arm assembly 26. The spray arm assembly may rotate in either clockwise, counter-clockwise, or mixed directions thereof. The rotational speed and direction of the spray arm assembly may be predetermined by a cycle of operation.

Typically, different portions of the treating chamber 16 may be sprayed by multiple ways. The spray arm assembly may continuously rotate about the axis of rotation in the tub 14 to provide a continuous spray of liquid to the utensils in the different portions of the basket. In another embodiment, separate rotatable sprayers may be positioned in the tub 14 to provide dedicated, additional spray of liquid to the utensils, for example, in the silverware basket.

Alternatively, the spray arm assembly may rotate about the axis of rotation in an incremental way as shown in FIGS. 3 and 4. The motor 46 may be configured to drive incrementally with a predetermined drive speed and stationary time between incremental movements. The spray arm assembly, which is operably coupled to the motor 46, may accordingly rotate incrementally in the controlled direction about the axis of rotation according to a cycle of operation.

Under this operational condition, the tub 14 may be conceptually divided into multiple portions in the form of multiple arc segments with one of them shown as shaded region in FIGS. 3 and 4, respectively. Each of arc segment A may be illustrated by an arc length B or arc angle C of the outer periphery of the each segment for which the spray arm assembly provides the spray of liquid. It is noted that, for the dishwasher 10 having more than one rack to store the utensils in the rack, each rack may be considered to include multiple arc segments within each rack.

The direction of rotation, such as clockwise or counterclockwise, of the spray arm assembly about the axis of rotation may be also selectively controlled by operation of the motor 46. The direction may alternate between clockwise and counterclockwise. The direction of rotation may be random and or predetermined. For example, the spray arm assembly 22 may rotate clockwise by 45 degrees, and then rotate counterclockwise by 45 degrees. The stationary time between incremental movements of the spray arm assembly 22 may be also selectively controlled.

Practically any operational conditions of the spray arm assemblies 22 in the dishwasher 10, such as the arc length, rotational speed, direction of rotation of the spray arm, a portion of outlets of the spray arm, and the stationary time during incremental movements, may be selected to provide any variable combination of spray arm rotation. Further, because the rotation is not coupled to the spraying of liquid, any possible rotation can be combined with either a spraying or non-spraying of liquid. Thus, the spray arm may sequentially or non-sequentially step through a single or multiple arc segments, with uni-directional or bi-directional rotation within a given arc segment, while spraying or not-spraying for a given arc segment.

In a practical implementation, it is contemplated that the arc segments will cover the area bound by the plane and liquid will be sprayed into all of the arc segments. This will provide full coverage of the plane within the rack and provide the most data that may be used as input to the controller so that the best decision may be made by the controller regarding the loading conditions in the rack.

Figure 5:
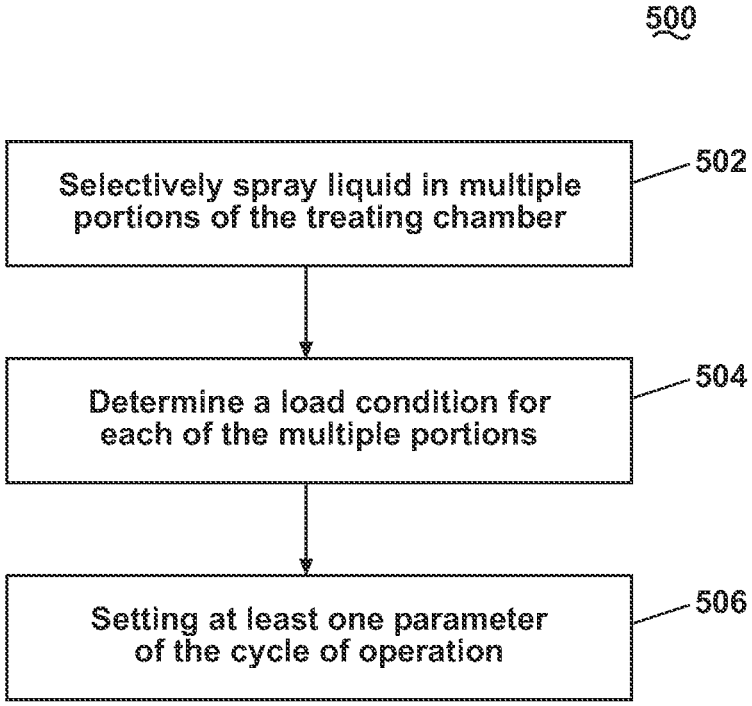
FIG. 5 is a flow chart of the operation of the dishwasher according to a fourth embodiment of the invention.

FIG. 5 is a flow chart of the operation of the dishwasher 10 according to a fourth embodiment of the invention. The sequence of steps depicted in FIG. 5 is for illustrative purposes only, and is not meant to limit the method in any way as it is understood that the steps may proceed in a different logical order, additional or intervening steps may be included, or described steps may be divided into multiple steps, without detracting from the invention. The method may be incorporated into a cycle of operation for the dishwasher 10, such as prior to or as part of any phase of the wash cycle, such as a pre-wash phase, wash phase, rinse phase, and drying phase. The method may also be a stand-alone cycle. It is noted that the method may be used with or without the utensils placed within the tub 14.

The method 500 may begin at 502 by selectively spraying liquid in multiple portions of the treating chamber of the dishwasher 10. The liquid may be sprayed from the rotating spray arm assemblies to the utensils located in multiple portions of the treating chamber 16 as described. It is noted that, for a dishwasher 10 having multiple spray arm assemblies such as two or three spray arm assemblies, the method may be applied to each of the spray arm assemblies.

The operating conditions for 502 may be input by the user through the user interface 70 while the operating conditions may be set by pre-programmed cycles of operation stored in the controller 64, depending on the output from one or more sensors coupled to the dishwasher 10. Non-limiting operating conditions include arc length B, arc angle C, rotational speed, stationary time between incremental movements, time for spraying liquid for each arc segment.

At 504, a load condition may be determined for each of the multiple portions of the treating chamber 16 by one or more sensors in the treating chamber 16. One or more sensors may be provided in the treating chamber 16 to sense at least one of the soil type, soil load, utensil type, and utensil arrangement, all of which may determine a set of load conditions for the wash load in each of the multiple portions of the treating chamber 16. The sensors may transmit an output signal which represent the load condition for each arc segment A during, after, or before a spray arm assembly incrementally rotates and selectively provide a spray of liquid to a predetermined arc segment.

For example, the sound sensor 61 may be provided to sense an acoustic signature such as a tone, frequency, or amplitude of vibrations that may be generated from the surface of the utensils in response to the liquid sprayed to the utensils located in each predetermined arc segment A. The acoustic signature may be effective in understanding the type or load of soil coupled to the utensils, location and load of utensils. The sound sensor 61 may also determine a load value at selected locations within the dishwasher 10. The load value may be reflective of a utensil load, i.e. the number and/or size of the utensils in the dishwasher 10, or a soil load, i.e. the quantity of soil coupled to the utensils. In another example, the turbidity sensor 62 may determine the turbidity of the liquid for each of the multiple portions of the dishwasher. The turbidity may be related with at least one of the soil load and soil type. In yet another example, the chemical sensor 63 may be provided to determine chemical characteristics, such as chemical composition of soil, of the liquid recirculated from each arc segment A. Multiple load conditions may be determined for each of the arc segments.

Output signals from one or more sensors may be sent out to the controller 64, where the load conditions for each of the multiple portions of the treating chamber 16 may be processed using one or more algorithms and look-up tables based on the output signals to provide the set of load condition for each of the multiple portions. For example, the acoustic signature from the sound sensor 61 may be compared to a reference acoustic signature table stored in the look-up table to figure out the load and type of utensils in each of the multiple portions of the treating chamber 16.

At 506, at least one parameter of the cycle of operation may be provided based on the set of load conditions determined at 504. Once a set of load conditions for the utensils are determined for each of the multiple portions, one or more parameters of the cycle of operation for each of the multiple portions may be modified or changed for current or subsequent wash cycle. The parameters of the cycle of operation may include at least one of setting a type of treating chemistry dispensed during the cycle of operation, setting an amount of treating chemistry dispensed during the cycle of operation, controlling the location of the spraying liquid, setting a duration of a wash phase of the cycle of operation, setting a number of wash phases for the cycle of operation, and setting a parameter of a drying phase such as a drying time or a drying temperature.

For example, if a set of load conditions determines that heavy food soils are coupled to utensils in an arc segment A, one or more parameters may be modified such that the arc segment A may be subject to, for example, an extended washing time period and/or increased amount of treating chemistry in the current or subsequent wash phase.

The invention described herein provides methods for operating a dishwasher where a load condition for each of the multiple portions of the treating chamber is determined. The methods of the invention can advantageously be used when the soil load, soil type, utensil type, and utensil arrangement in the basket is not uniform and therefore selectively tailored treatment is necessary for improved treatment results. The possibility of soils untreated on the utensil after a cycle of operation may be greatly reduced by selectively spraying liquid for each of the multiple portions of the treating chamber and then determining a load condition for each of the multiple portions.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a dishwasher having a tub at least partially defining a treating chamber for receiving utensils to form a wash load, a spraying system having at least one rotatable spray arm, a liquid supply system supplying liquid to the spraying system, and a drive mechanism for rotating at least one rotatable spray arm controlled according to a cycle of operation, the method comprising:

operating the drive mechanism to incrementally rotate the rotatable spray arm through multiple portions of the treating chamber about an axis of rotation and independently of the supply of liquid to the at least one rotatable spray arm;

selectively spraying liquid in the multiple portions of the treating chamber during the incremental rotation;

receiving a load input for at least some of the multiple portions from at least one sensor in response to the selectively spraying;

determining a load condition for at least those multiple portions having a load input to define a set of load conditions for the wash load; and setting at least one parameter of the cycle of operation based on the set of load conditions, wherein the incrementally rotating the rotatable spray arm comprises rotating the rotatable spray arm about an axis of rotation that is fixed relative to the treating chamber and rotating a rotatable spray arm that spans substantially an entire width of the tub.

2. The method of claim 1 wherein the incrementally rotating the rotatable spray arm comprises rotating the rotatable spray arm through a predetermined arc length to define one of the multiple portions.

3. The method of claim 2 wherein the rotating the rotatable spray arm through the predetermined arc length comprises rotating the rotatable spray arm back and forth within the predetermined arc length.

4. The method of claim 3 wherein the incrementally rotating comprises rotating the rotatable spray arm through at least 180 degrees.

5. The method of claim 2 wherein the predetermined arc length is 30 degrees.

6. The method of claim 5 wherein the rotatable spray arm is rotated through multiple, different 30 degree arc segments.

7. The method of claim 6 wherein the multiple 30 degree arc segments have a cumulative arc length of at least 360 degrees.

8. The method of claim 1 wherein at least some of the multiple portions overlap.

9. The method of claim 1 wherein the determining a load condition comprises determining at least one of soil load, soil type, utensil type, and utensil arrangement.

10. The method of claim 9 wherein the determining the soil load comprises determining a turbidity of the liquid.

11. The method of claim 10 wherein the determining the turbidity comprises determining a change in turbidity between the multiple portions.

12. The method of claim 9 wherein the setting the at least one parameter comprises at least one of setting an amount of treating chemistry dispensed during the cycle of operation, controlling a location of the spraying liquid within the treating chamber, setting a duration of a wash phase of the cycle of operation, and setting a number of wash phases for the cycle of operation.

13. The method of claim 1 wherein the setting the at least one parameter comprises at least one of setting a type of treating chemistry dispensed during the cycle of operation, setting an amount of treating chemistry dispensed during the cycle of operation, controlling a location of the spraying liquid within the treating chamber, setting a duration of a wash phase of the cycle of operation, setting a number of wash phases for the cycle of operation, and setting a parameter of a drying phase.

14. The method of claim 1 wherein the selectively spraying liquid comprises spraying liquid from a radially extending portion of the rotatable spray arm.

15. The method of claim 14 wherein spraying liquid from the radially extending portion of the rotatable spray arm comprises spraying liquid from only one radially extending portion of the rotatable spray arm, which has multiple radially extending portions therefrom.

* * * * *